US011717069B2

(12) United States Patent
Weng et al.

(10) Patent No.: US 11,717,069 B2
(45) Date of Patent: Aug. 8, 2023

(54) DRAW BAR STRUCTURE WITH MULTIFUNCTIONAL BRACKET AND MULTIFUNCTIONAL SUITCASE

(71) Applicant: TAIXIN (SUZHOU) TRAVEL ACCESSORIES CO., LTD., Jiangsu (CN)

(72) Inventors: I-hsuan Weng, Jiangsu (CN); Po-Lun Chi, Jiangsu (CN); Chin-hua Yang, Jiangsu (CN)

(73) Assignee: TAIXIN (SUZHOU) TRAVEL ACCESSORIES CO., LTD., Suzhou (CN)

( * ) Notice: Subject to any disclaimer, the term of this patent is extended or adjusted under 35 U.S.C. 154(b) by 91 days.

(21) Appl. No.: 17/334,665

(22) Filed: May 28, 2021

(65) Prior Publication Data

US 2021/0282520 A1 Sep. 16, 2021

(30) Foreign Application Priority Data

May 28, 2020 (CN) ..... 202010465415.1

(51) Int. Cl.
*A45C 13/28* (2006.01)
*A45C 13/26* (2006.01)

(52) U.S. Cl.
CPC ..... *A45C 13/28* (2013.01); *A45C 13/262* (2013.01); *A45C 2013/267* (2013.01)

(58) Field of Classification Search
CPC . A45C 13/28; A45C 13/262; A45C 2013/267; A45C 5/045; A45C 5/14
USPC ..... 248/310, 296.1, 295.11, 291.1
See application file for complete search history.

(56) References Cited

U.S. PATENT DOCUMENTS 4,828,211 A * 5/1989 McConnell ..... B60N 3/102 248/316.4
D307,224 S * 4/1990 Mizukami ..... D7/619.1
4,984,722 A * 1/1991 Moore ..... B60N 3/102 224/558
5,014,956 A * 5/1991 Kayali ..... B60N 3/106 248/311.2
5,072,909 A * 12/1991 Huang ..... B60N 3/102 248/316.4

(Continued)

OTHER PUBLICATIONS

Tugo: (https://www.amazon.com/exec/obidos/ASIN/B003U2Z50U/b00dra2xfa-20), (Year: 2011).*

*Primary Examiner* — Jennifer Robertson
*Assistant Examiner* — Justin Caudill

(57) ABSTRACT

The present invention discloses a draw bar structure with a multifunctional bracket and a multifunctional suitcase. The draw bar structure with the multifunctional bracket includes a draw bar body. A bracket fixing seat is transversely arranged between two draw bars of the draw bar body; the multifunctional bracket is fixed on the bracket fixing seat and positioned between the two draw bars; the multifunctional bracket is of a foldable structure; and the multifunctional bracket at least has one functional surface after unfolded. In the draw bar structure with the multifunctional bracket and the multifunctional suitcase in the present application, the multifunctional bracket is added on the draw bars, so that use convenience is brought to a user, and overall sense of line and attractive appearance of the suitcase are not affected.

15 Claims, 6 Drawing Sheets

(56) References Cited

U.S. PATENT DOCUMENTS

| | | | | | |
|---|---|---|---|---|---|
| 5,318,266 | A * | 6/1994 | Liu | B60N 3/106 | 248/292.12 |
| 5,423,508 | A * | 6/1995 | Isenga | B60N 3/108 | 224/407 |
| 5,522,527 | A * | 6/1996 | Tsai | B62J 29/00 | 224/558 |
| 5,601,268 | A * | 2/1997 | Dunchock | B60N 3/106 | 248/311.2 |
| 5,603,477 | A * | 2/1997 | Deutsch | B60N 3/106 | 248/292.12 |
| 6,047,937 | A * | 4/2000 | Huang | B60N 3/102 | 248/312.1 |
| 6,227,509 | B1 * | 5/2001 | Plocher | B60N 3/102 | 248/128 |
| 2006/0175507 | A1 * | 8/2006 | Bertsch | A47G 23/0225 | 248/311.2 |
| 2006/0243768 | A1 * | 11/2006 | Dowell | B60R 11/00 | 224/400 |
| 2008/0116342 | A1 * | 5/2008 | Oliver | A47G 23/0225 | 248/311.2 |
| 2013/0092808 | A1 * | 4/2013 | Adachi | B60N 3/102 | 248/311.2 |
| 2014/0299428 | A1 * | 10/2014 | Gadbois | A45C 9/00 | 190/11 |
| 2016/0113388 | A1 * | 4/2016 | Distefano | A45C 5/14 | 108/41 |
| 2017/0238669 | A1 * | 8/2017 | Jose | A45C 13/28 | |
| 2017/0310151 | A1 * | 10/2017 | Curescu | H02J 7/0042 | |
| 2018/0271310 | A1 * | 9/2018 | Klugh | A47G 23/0225 | |
| 2019/0069659 | A1 * | 3/2019 | Van Loon | A45C 13/02 | |
| 2020/0107621 | A1 * | 4/2020 | Sluder | A45C 13/28 | |

* cited by examiner

DRAW BAR STRUCTURE WITH MULTIFUNCTIONAL BRACKET AND MULTIFUNCTIONAL SUITCASE

CROSS-REFERENCE TO RELATED APPLICATIONS

This application claims the benefit of priority from Chinese Patent Application No. 202010465415.1, filed on May 28, 2020. The content of the aforementioned application, including any intervening amendments thereto, is incorporated herein by reference in its entirety.

TECHNICAL FIELD

The present invention relates to the technical field of bags and suitcases, and particularly relates to a draw bar with a multifunctional bracket and a multifunctional suitcase.

BACKGROUND OF THE PRESENT INVENTION

Suitcases used during travels of people mainly provide spaces for placing clothes and daily necessities generally, and have no placement location from which personal belongings (such as cups, magazines, mobile phones and power banks) cannot be conveniently fetched. Although the personal belongings may be put in the suitcase, the belongings are not convenient to be fetched. Cup holders and the like are added on the suitcase body by some manufacturers, thereby affecting the overall sense of line of the suitcase and making the overall suitcase unaesthetic.

SUMMARY OF THE PRESENT INVENTION

The present application provides a draw bar structure with a multifunctional bracket and a multifunctional suitcase. A purpose of the present invention is to solve the problem that the existing suitcase is low in utilization ratio and unaesthetic.

To achieve the above purpose, technical solutions adopted in the present application are as follows:

The draw bar structure with the multifunctional bracket includes a draw bar body. A bracket fixing seat is transversely arranged between two draw bars of the draw bar body; the multifunctional bracket is fixed on the bracket fixing seat and positioned between the two draw bars; the multifunctional bracket is of a foldable structure; and the multifunctional bracket at least has one functional surface after unfolded.

Preferably, the multifunctional bracket includes a bottom support, a main body and a fork frame, wherein the top of the main body is fixed on the bracket fixing seat; the fork frame is fixed at the upper end of the main body by a fork frame rotating shaft; the fork frame can be unfolded or folded relative to the main body; both ends of the bottom support are connected to the lower end of the main body by a rotating shaft; the bottom support can be folded up and down relative to the main body by taking the rotating shaft as a supporting point; and the fork frame is covered in the bottom support when the bottom support is in a folded state.

Preferably, symmetrical slots are formed in the fork frame rotating shaft; raised fixture blocks are arranged on the top of the fork frame and correspondingly clamped into the slots respectively; and the fixture blocks drive the fork frame to horizontally move along the slots relative to the main body.

Preferably, an elastic mechanism is arranged on each of inner side surfaces of the main body relative to the fork frame and the bottom support; each elastic mechanism is a plastic rack body raised from the main body; the plastic rack body and the main body are integrally molded; and the elastic mechanism is abutted against the fork frame and the bottom support by utilizing elasticity of the plastic rack body.

Preferably, one surface of the raised block connected with the fork frame or the bottom support is a plane.

Preferably, raised guard bars are arranged at the periphery of an inner surface of the bottom support.

Preferably, the fork frame is composed of two symmetrical frame bodies; and an opened perforation is formed between the opposite frame bodies.

Preferably, the bracket fixing seat is fixed at an upper end of the draw bar or on a first section of the draw bar.

Preferably, an adjusting button is arranged on the bracket fixing seat; an adjusting mechanism is arranged inside the bracket fixing seat; and the draw bar is locked or unlocked by the adjusting mechanism under control of the adjusting button, so that the bracket fixing seat can be movably adjusted up and down relative to the draw bar.

The present application further discloses a multifunctional suitcase, including a suitcase body; the suitcase body is provided with the above draw bar structure with the multifunctional bracket; a containing space is formed in the back of the suitcase body and positioned between the two draw bars; the multifunctional bracket is inserted into the containing space; and while needing to be used, the multifunctional bracket is withdrawn from the containing space.

Through the above technical solutions, the draw bar structure with the multifunctional bracket and the multifunctional suitcase in the present application add the multifunctional bracket on the draw bars, so that use convenience is brought to a user, and overall sense of line and attractive appearance of the suitcase are not affected.

DETAILED DESCRIPTION OF THE PRESENT INVENTION

Technical solutions of the present invention will be further specifically described below through embodiments and in combination with drawings.

Figure 1:
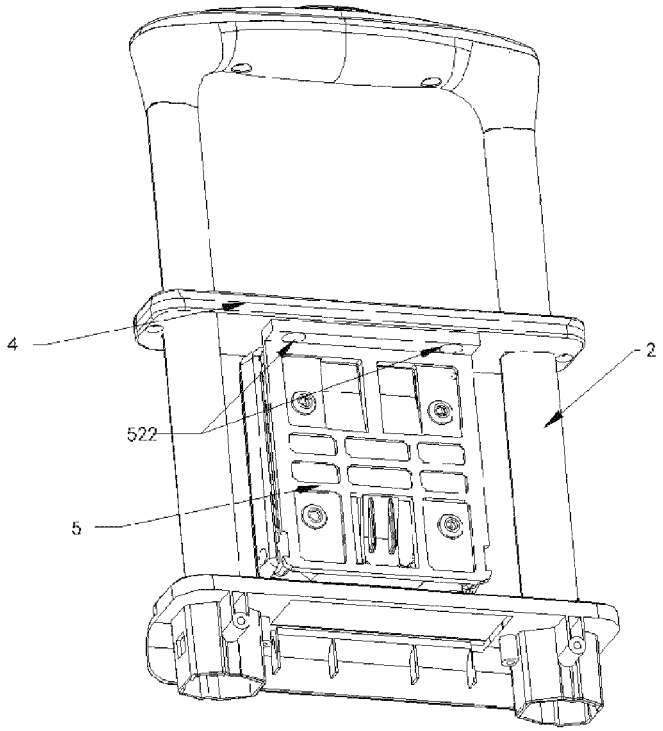
FIG. 1 is a structural schematic diagram of a draw bar structure in one embodiment of the present application.

As shown in FIG. 1, a draw bar structure with a multifunctional bracket in the present application includes a draw bar body; and the draw bar body includes a handle 1, two draw bars 2 and two draw bar fixing racks 3 arranged at the bottom end. As shown in FIG. 1, a bracket fixing seat 4 is transversely arranged between two draw bars 2. The multifunctional bracket 5 is fixed on the bracket fixing seat 4 by means of screw twisting fixation (the fixing manner is not limited thereto). The multifunctional bracket 5 is positioned between the two draw bars 2. The multifunctional bracket 5 in the present application is of a foldable structure; and a preferred width after folding does not exceed a width of the draw bar, so that the multifunctional bracket is convenient to be stored. While needing to be used, the multifunctional bracket at least has one functional surface after unfolded.

As shown in FIGS. 1-4 and FIG. 6, as one embodiment of the multifunctional bracket in the present application, the multifunctional bracket 5 in the present embodiment includes a bottom support 51, a main body 52 and a fork frame 53.

Figure 2:
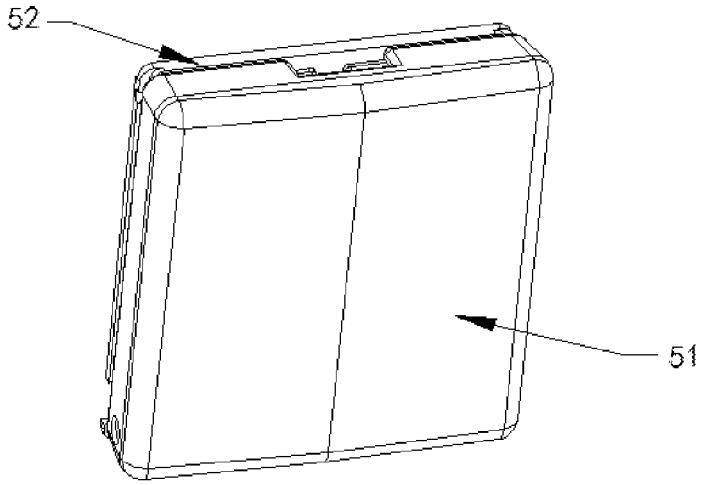
FIG. 2 is a first figure of a folded state of a multifunctional bracket in an embodiment of FIG. 1.
Figure 3:
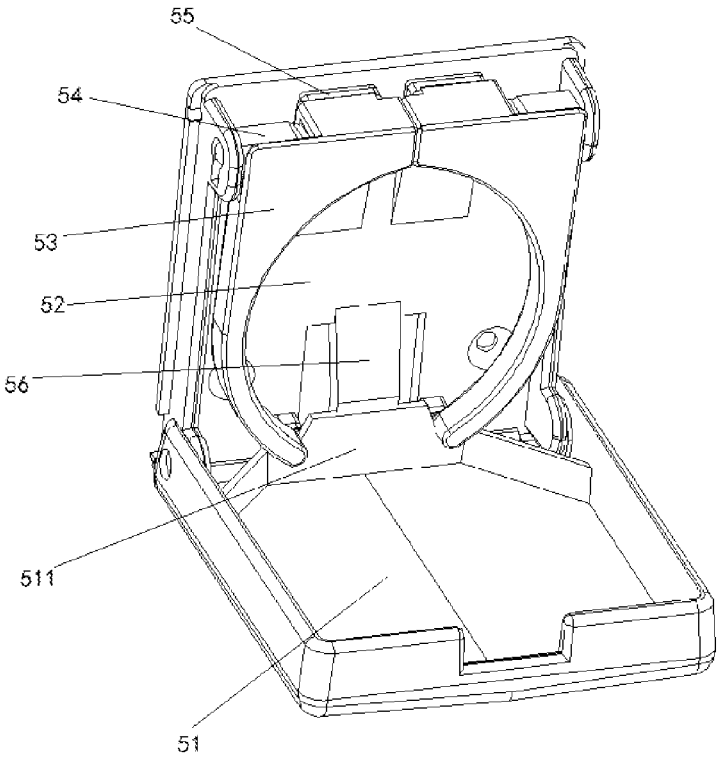
FIG. 3 is a second figure of an unfolded state of a bottom support of a multifunctional bracket in an embodiment of FIG. 1.
Figure 4:
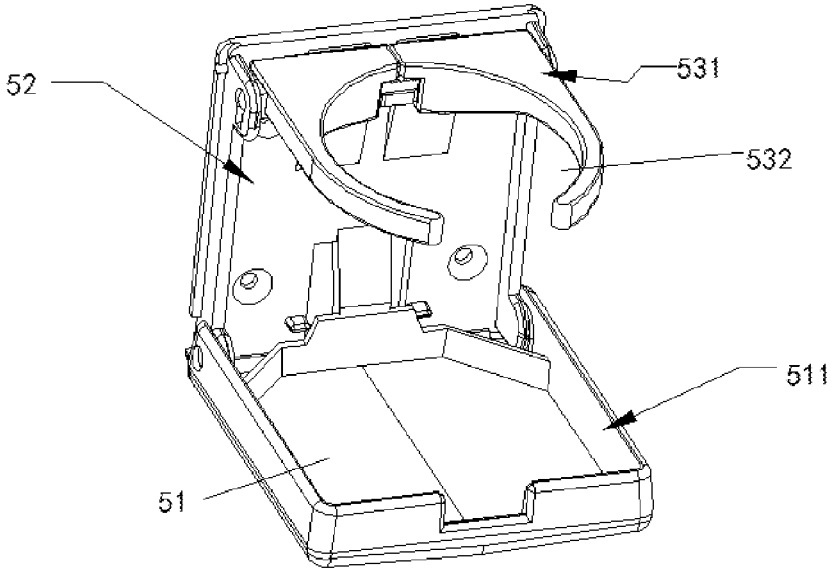
FIG. 4 is a schematic diagram of unfolded states of a bottom support and a fork frame in an embodiment of FIG. 1.

The top of the main body 52 is fixed on the bracket fixing seat 4. The fork frame 53 is fixed at the upper end of the main body 52 by a fork frame rotating shaft 54. Due to the effect of the fork frame rotating shaft 54, the fork frame 53 can be unfolded or folded relative to the main body 52. Both ends of the bottom support 51 are connected to the lower end of the main body 52 by a rotating shaft 521 (or a bolt). The bottom support 51 can be folded up and down relative to the main body 52 by taking the rotating shaft 511 as a supporting point. The fork frame 53 is covered in the bottom support when the bottom support 51 is in a folded state so as to form an integral state, as shown in FIG. 2.

Figure 5:
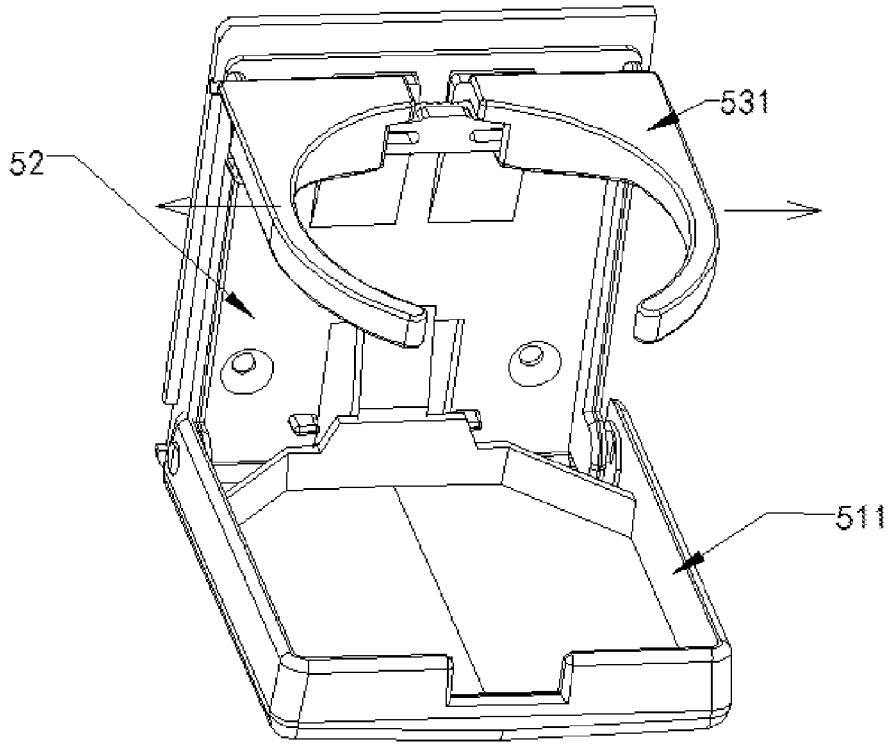
FIG. 5 is a schematic diagram of movement of a fork frame in an embodiment of FIG. 1.
Figure 6:
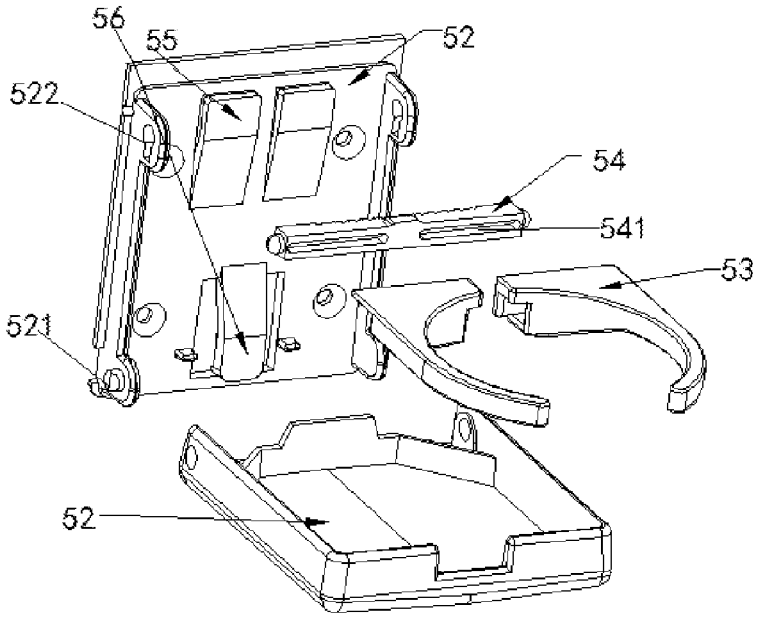
FIG. 6 is a decomposition diagram of a multifunctional bracket in an embodiment of FIG. 1.

As shown in FIGS. 5 and 6, the fork frame 53 is composed of two symmetrical frame bodies 531; and an opened perforation 532 is formed between the opposite frame bodies 531. The perforation 532 can be used for placing small articles such as cups, magazines or clothes. The fork frame 53 is combined with the main body 52 by the fork frame rotating shaft 54. Two symmetrical slots 541 are formed in the fork frame rotating shaft 54; raised fixture blocks are arranged on the top of the fork frame 53 and respectively correspondingly clamped into the slots 541; and the fixture blocks can drive the fork frame to horizontally move along the slots relative to the main body. Due to the movement in the slots 541, in addition to change of the location of the perforation 532, a size of the perforation 532 may also be changed, so that the perforation is applicable to different articles.

Figure 9:
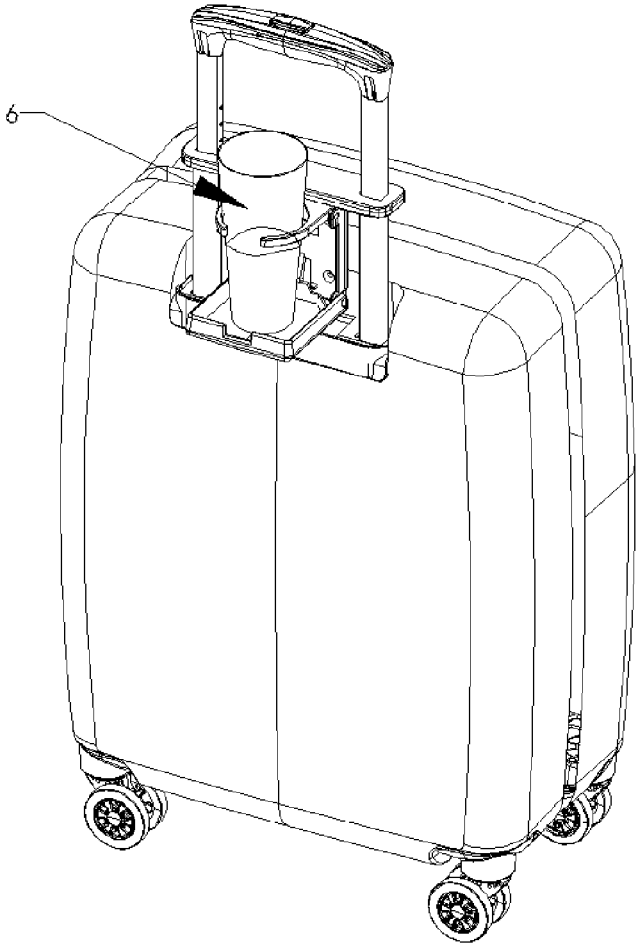
FIG. 9 is a schematic diagram of use of a suitcase in the present application.

As shown in FIG. 6, raised guard bars 511 are arranged at the periphery of an inner surface of the bottom support 51. The bottom support 51 is another functional surface and serves as a functional surface matched with the fork frame 53. As shown in FIG. 9, when a cup body 6 is placed in the perforation 532 of the fork frame 53, the bottom of the cup body 6 can be supported by the bottom support 51. In addition, through the design of the guard bars 511, articles placed on the bottom support 51 may be further maintained by the bottom support 51 (e.g., some small articles are directly arranged on the bottom support 51), thereby preventing the articles from dropping in a process of moving the suitcase. When closed, the guard bars 511 serving as integral side walls are closed at the peripheries of the bottom support 51 and the main body 52.

As shown in FIGS. 1, 3, 4 and 6, a fixing edge 522 that extends outwards is arranged on the top of the main body 52; and the main body is fixed on the bracket fixing seat 4 by the fixing edge 522. Bayonets 522 for fixing the fork frame rotating shaft 54 are arranged on two side edges of the upper end of the main body 52; and rotating shafts 521 for fixing the bottom support 51 are arranged on two sides of the lower end of the main body 52. Parallel first elastic mechanisms 55 located at the upper end and a single second elastic mechanism 56 located at the lower end are arranged on the inner surface of the main body 52. The first elastic mechanisms 55 are located on the inner side of the fork frame rotating shaft; the second elastic mechanism 56 is abutted against the guard bars on the bottom support 51; the first elastic mechanisms 55 and the second elastic mechanism 56 are abutted against the corresponding frame bodies 531 and the bottom support respectively; and by virtue of elasticity of the elastic mechanisms, the rack bodies and the bottom support are pushed to be in an unfolded state so as to support the rack bodies and the bottom support. Each of the elastic mechanisms is a plastic rack body raised from the main body; and the plastic rack body and the main body are integrally molded.

Thus, totally two functional surfaces are shown in the present embodiment, i.e., the fork frame 53 and the bottom support 51. However, the present application is not limited thereto. Any improvements made on the basis of the present application, such as addition of other functional structures on the fork frame, the bottom support or the main body surface, or addition of functional surfaces, shall belong to the protection scope of the present application.

Figure 8:
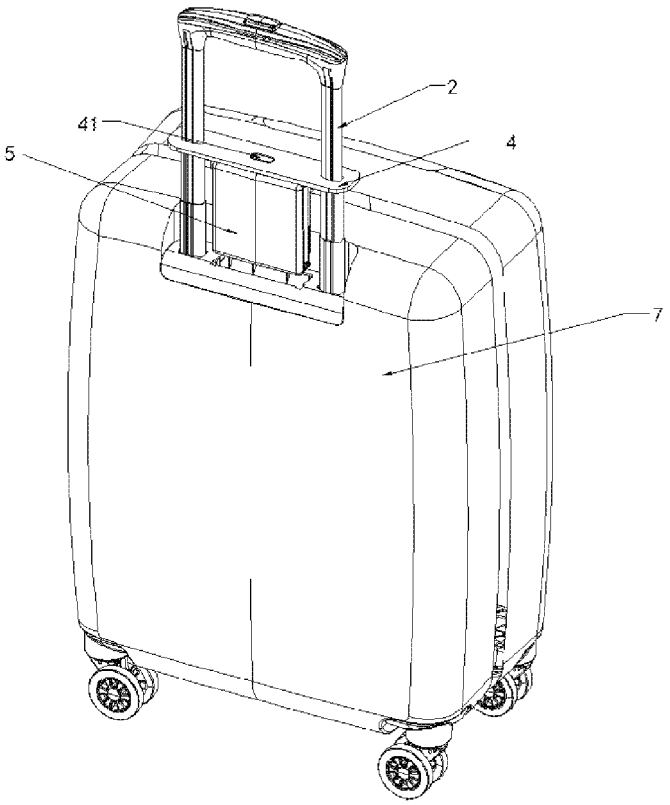
FIG. 8 is a structural schematic diagram II of a suitcase in the present application.

In addition, in combination with FIGS. 1, 8 and 9, the bracket fixing seat 4 in the present application is fixed at an upper end of the draw bar 2 or on a first section of the draw bar. An adjusting button 41 is arranged on the bracket fixing seat 4; an adjusting mechanism is arranged inside the bracket fixing seat 4; and the draw bar is locked or unlocked by the adjusting mechanism under control of the adjusting button 41, so that the bracket fixing seat can be movably adjusted up and down relative to the draw bar. The form of the adjusting mechanism is not limited, as long as the needs of the present application can be met. Through the design of the adjusting button 41 and the adjusting mechanism, the bracket fixing seat can be adjusted up and down and the multifunctional bracket 5 can be stored.

Figure 7:
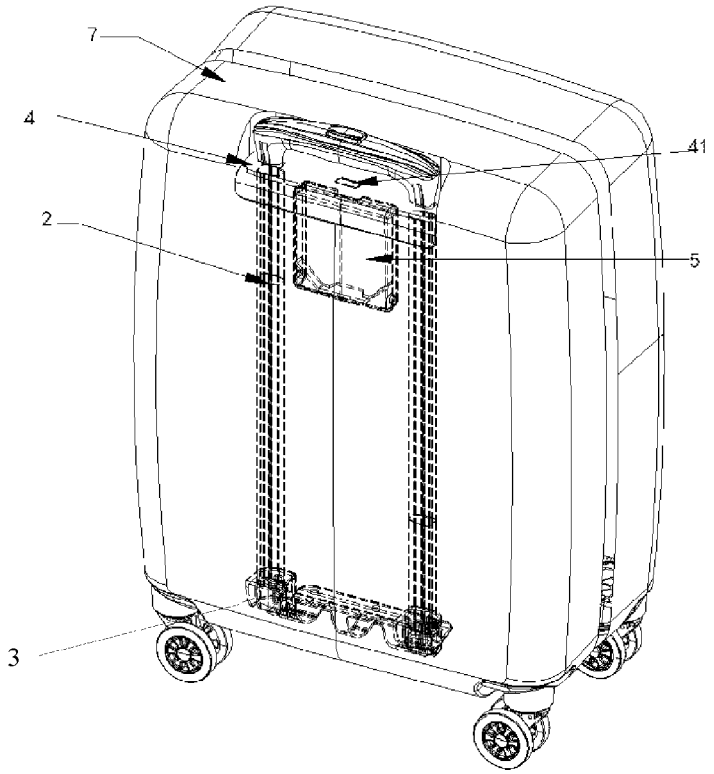
FIG. 7 is a structural schematic diagram I of a suitcase in one embodiment of the present application.

FIGS. 7 and 8 show a multifunctional suitcase disclosed in embodiments of the present application. The multifunctional suitcase includes a suitcase body 7; and the suitcase body 7 is provided with the above draw bar structure with the multifunctional bracket. A containing space is formed in the back of the suitcase body 7 and positioned between the two draw bars 2; the multifunctional bracket is inserted into the containing space; and while needing to be used, the multifunctional bracket is withdrawn from the containing space. Thus, when not used, the multifunctional bracket 5 is not exposed on the outer side of the suitcase body 7, thereby not affecting the overall appearance and the sense of line of the suitcase body.

The above embodiments are merely used for describing the present invention, rather than limiting the scope of the present invention. Equivalent changes and modifications made to the present invention by those skilled in the art shall belong to the coverage scope of claims in the present invention.

What is claimed is:

1. A draw bar structure with a multifunctional bracket, comprising a draw bar body, wherein a bracket fixing seat is transversely arranged between two draw bars of the draw bar body; the multifunctional bracket is fixed on the bracket fixing seat and positioned between the two draw bars; the multifunctional bracket is of a foldable structure; and the multifunctional bracket has at least one functional surface after unfolded;

the multifunctional bracket comprises a bottom support, a main body and a fork frame, a fixing edge that extends outwards is arranged on the top of the main body; and the main body is fixed on the bracket fixing seat by the fixing edge, a width of the multifunctional bracket after folding is smaller than a width between the two draw bars;

an adjusting button is arranged on the bracket fixing seat to lock or unlock the draw bars under control of the adjusting button, so that the bracket fixing seat can be movably adjusted up and down relative to the draw bars.

2. The draw bar structure with the multifunctional bracket according to claim 1, wherein the fork frame is fixed at the upper end of the main body by a fork frame rotating shaft, and the fork frame can be unfolded or folded relative to the main body;

the bottom support is connected to a lower end of the main body by a bottom support rotating shaft; the bottom support can be folded up and down relative to the main body by taking the bottom support rotating shaft as a supporting point; and the fork frame is covered in the bottom support when the bottom support is in a folded state.

3. The draw bar structure with the multifunctional bracket according to claim 2, wherein symmetrical slots are formed in the fork frame rotating shaft;

raised fixture blocks are arranged on the top of the fork frame and correspondingly clamped into the slots respectively; and the fixture blocks drive the fork frame to horizontally move along the slots relative to the main body.

4. The draw bar structure with the multifunctional bracket according to claim 2, wherein an elastic mechanism is arranged on an inner side surface of the main body; the elastic mechanism includes a plurality of plastic rack bodies raised from the main body; the plastic rack bodies and the main body are integrally molded; and the elastic mechanism is respectively abutted against the fork frame and the bottom support by utilizing elasticity of the plastic rack bodies.

5. The draw bar structure with the multifunctional bracket according to claim 4, wherein one surface of the plastic rack body connected with the fork frame or the bottom support is a plane.

6. The draw bar structure with the multifunctional bracket according to claim 2, wherein raised guard bars are arranged at the periphery of an inner surface of the bottom support.

7. The draw bar structure with the multifunctional bracket according to claim 2, wherein the fork frame is composed of two symmetrical frame bodies; and an opened perforation is formed between the opposite frame bodies.

8. The draw bar structure with the multifunctional bracket according to claim 1, wherein the bracket fixing seat is fixed at an upper end of the draw bar or on an upmost telescopic section of the draw bar.

9. A multifunctional suitcase, comprising a suitcase body, wherein the suitcase body is provided with a draw bar structure with a multifunctional bracket comprising a draw bar body, wherein a bracket fixing seat is transversely arranged between two draw bars of the draw bar body; the multifunctional bracket is fixed on the bracket fixing seat and positioned between the two draw bars; the multifunctional bracket is of a foldable structure; and the multifunctional bracket at least has one functional surface after unfolded;

the multifunctional bracket comprises a bottom support, a main body and a fork frame, a fixing edge that extends outwards is arranged on the top of the main body; and the main body is fixed on the bracket fixing seat by the fixing edge, a width of the multifunctional bracket after folding is smaller than a width between the two draw bars;

an adjusting button is arranged on the bracket fixing seat lock or unlock the draw bars under control of the adjusting button, so that the bracket fixing seat can be movably adjusted up and down relative to the draw bars;

a containing space is formed in the back of the suitcase body and positioned between the two draw bars; the multifunctional bracket is inserted into the containing space; and while needing to be used, the multifunctional bracket is withdrawn from the containing space.

10. The multifunctional suitcase according to claim 9, the fork frame is fixed at the upper end of the main body by a fork frame rotating shaft, and the fork frame can be unfolded or folded relative to the main body;

the bottom support is connected to a lower end of the main body by a bottom support rotating shaft the bottom support can be folded up and down relative to the main body by taking the bottom support rotating shaft as a supporting point and the fork frame is covered in the bottom support when the bottom support is in a folded state.

11. The multifunctional suitcase according to claim 10, wherein symmetrical slots are formed in the fork frame rotating shaft raised fixture blocks are arranged on the top of the fork frame and correspondingly clamped into the slots respectively; and the fixture blocks drive the fork frame to horizontally move along the slots relative to the main body.

12. The multifunctional suitcase according to claim 10, wherein an elastic mechanism is arranged on an inner side surface of the main body; the elastic mechanism includes a plurality of plastic rack bodies raised from the main body; the plastic rack bodies and the main body are integrally molded; and the elastic mechanism is respectively abutted against the fork frame and the bottom support by utilizing elasticity of the plastic rack bodies.

13. The multifunctional suitcase according to claim 12, wherein one surface of the plastic rack body connected with the fork frame or the bottom support is a plane.

14. The multifunctional suitcase according to claim 10, wherein raised guard bars are arranged at the periphery of an inner surface of the bottom support.

15. The multifunctional suitcase according to claim 10, wherein the fork frame is composed of two symmetrical frame bodies; and an opened perforation is formed between the opposite frame bodies.

* * * * *